US007726729B2

(12) United States Patent
Groll

(10) Patent No.: US 7,726,729 B2
(45) Date of Patent: Jun. 1, 2010

(54) STANDING AID FOR RISERS

(76) Inventor: William A. Groll, 126 Old Oak Rd., McMurray, PA (US) 15317

( * ) Notice: Subject to any disclaimer, the term of this patent is extended or adjusted under 35 U.S.C. 154(b) by 0 days.

(21) Appl. No.: 12/173,066

(22) Filed: Jul. 15, 2008

(65) Prior Publication Data

US 2010/0013280 A1 Jan. 21, 2010

(51) Int. Cl.
*A47C 1/16* (2006.01)

(52) U.S. Cl. ..... 297/4; 297/252; 297/352

(58) Field of Classification Search ..... 297/4, 297/252, 352
See application file for complete search history.

(56) References Cited

U.S. PATENT DOCUMENTS

| | | | | | |
|---|---|---|---|---|---|
| 226,252 | A * | 4/1880 | Smith et al | 297/4 |
| 406,328 | A * | 7/1889 | Yagn | 297/4 X |
| 671,638 | A * | 4/1901 | Slagle | 297/4 |
| 690,122 | A * | 12/1901 | Slagle | 297/4 X |
| 2,631,652 | A * | 3/1953 | Bannister | 297/4 |
| 2,754,891 | A * | 7/1956 | Barron | 297/352 |
| 3,310,340 | A * | 3/1967 | Brewer et al. | 297/16.1 |
| 3,467,033 | A * | 9/1969 | Remer | 108/150 |
| 4,098,478 | A * | 7/1978 | Spitzke | 297/4 X |
| 4,101,163 | A * | 7/1978 | Morin | 297/4 X |
| 4,232,896 | A * | 11/1980 | Caldwell | 297/4 |
| 4,433,870 | A * | 2/1984 | Bairen et al. | 297/4 X |
| 4,451,080 | A * | 5/1984 | Nix | 297/4 |
| 4,565,409 | A * | 1/1986 | Hollonbeck et al. | 297/411.1 |
| 4,641,882 | A * | 2/1987 | Young | 297/4 X |
| 4,676,547 | A * | 6/1987 | Spillman | 297/4 |
| 4,803,945 | A * | 2/1989 | Adams et al. | 114/363 |
| 5,470,038 | A * | 11/1995 | Clark | 248/156 |
| 5,673,966 | A * | 10/1997 | Morton, Jr. | 297/4 |
| 5,927,797 | A * | 7/1999 | Ferguson | 297/4 |
| 5,954,248 | A * | 9/1999 | Jasper | 297/4 X |
| 6,035,572 | A * | 3/2000 | Goode, Jr. | 42/94 |
| 6,062,638 | A * | 5/2000 | Ferguson | 297/4 |
| 6,893,097 | B1 * | 5/2005 | Ebensperger et al. | 297/4 X |
| 6,997,511 | B2 * | 2/2006 | Marchand et al. | 297/314 |
| 7,325,868 | B2 * | 2/2008 | West et al. | 297/4 |
| 7,396,083 | B2 * | 7/2008 | Kasner | 297/4 X |

* cited by examiner

*Primary Examiner*—Rodney B White
(74) *Attorney, Agent, or Firm*—The Webb Law Firm

(57) ABSTRACT

A standing aid for supporting a person and relieving leg fatigue while standing on a riser step. The standing aid comprises a seat capable of supporting a person standing on the riser step, a vertical stand having a top end secured to the seat and a mounting system secured to a bottom end of the vertical stand. The mounting system has a clamp having a first surface for extending over and in contact with a top surface of the riser step and a second surface for extending below and in contact with a bottom surface of the riser step. The first surface of the mounting system has a relatively small footprint in that it has a second predetermined width which is less than the first predetermined width of the riser step. This small footprint allows people to maneuver around the standing aid while moving on and off the riser step.

20 Claims, 6 Drawing Sheets

STANDING AID FOR RISERS

BACKGROUND OF THE INVENTION

1. Field of the Invention

The present invention relates generally to an aid to assist one while standing, and in particular, to a standing aid capable of being mounted on a riser step to support a person and prevent leg fatigue while standing on the risers for long periods of time during choral practice and/or performance.

2. Description of the Related Art

Choral singers in schools, churches and clubs can range in age from pre-school to senior citizens. Although choral rehearsals are often done sitting in chairs, choral performances are almost always done standing on stage risers. Risers are usually portable equipment that provides elevated consecutive steps for the singers to stand on. When standing on the risers, each row of singers is elevated slightly above the row in front of them, making it possible for the singers to clearly see the director and to be heard clearly by the audience. A singer's position on the riser is determined by which musical part they are singing. Singers of the same musical part are clustered together. Performers are often required to file on and file off the risers in view of an audience or to move around on the risers to accommodate small groups or soloists from within the group. These performers exit and return to the risers during performances.

Some performers, who may be able to attend rehearsals, learn the music and sing well, may not be able to perform in concerts because they cannot stand for the duration of a show. Age, injury or infirmity can limit a singer's ability to stand for long periods and, thus, prevent them from participating in choral music. Placement of chairs or stools on portable risers represents a falling hazard and restricts the movement of the group as they move on and off the risers. Chairs would also place a singer below the level of standing singers. Chairs or stools on the floor level may be accommodated in some cases, but would often require a singer not to be placed in their appropriate section.

A riser chair, produced by Peery Products Company, Inc. comprises a padded, full size swivel seat which can be attached to a riser step for use by persons who cannot stand for long periods of time. The user of the chair is able to sit comfortably at a height which is level with the standing performers. The riser chair includes a sturdy base which is mounted and locked in place on the riser step. The base extends the entire width of the riser step. Consequently, the size of this base presents a hazard to the performers as they enter and exit the risers because it is difficult to maneuver about the riser chair. Additionally, the riser chair is somewhat large and bulky and weighs about 33 pounds. Thus, manipulation and/or movement of the chair, including attachment and removal from the riser step, would be difficult.

SUMMARY OF THE INVENTION

It is, therefore, an object of the present invention to provide a standing aid for use on risers that overcomes the drawbacks and deficiencies of the prior art. It is another object of the present invention to provide a standing aid that is compact and lightweight to facilitate transportation and storage as well as attachment and removal from the risers. It is yet another object of the present invention to provide a standing aid that has a small footprint and provides little or no impedance to movement on and off the risers. It is still another object of the present invention to provide a standing aid having an adjustable height and seat angle to support the singer in a near full standing position, while providing relief from leg fatigue. It is a further object of the present invention to provide a standing aid having a lever arm design which minimizes the footprint of the standing aid while providing a secure clamping force on the riser step. It is yet a further object of the present invention to provide a standing aid having a locking bar mechanism that prevents accidental dislodging.

Accordingly, the present invention is directed to a standing aid for supporting a person standing on a riser step wherein riser step has a first predetermined width. The standing aid comprises a seat capable of supporting a person standing on the riser step, a vertical stand having a top end secured to the seat and a mounting system secured to a bottom end of the vertical stand. The mounting system has a clamp having a first and second opposing surface. The first surface is capable of extending over and in contact with a top surface of the riser step and the second surface is capable of extending below and in contact with a bottom surface of the riser step. The first surface of the mounting system has a relatively small footprint in that it has a second predetermined width which is less than the first predetermined width of the riser step. This small footprint allows people to maneuver around the standing aid while moving on and off the riser step. The standing aid further includes a securing member for securing the mounting system about the riser step.

According to a first embodiment, the mounting system and securing member of the invention comprises a clamp having a first and second opposing surface wherein the second opposing surface comprises a bottom contact bar adjustably mounted on a first end of a bottom arm member. This bottom arm member is capable of extending in a parallel direction with respect to the riser step. An arm offset member connects a second end of the bottom arm member and the bottom end of the vertical stand wherein the arm offset member extends in a perpendicular direction with respect to the riser step. The mounting system also includes a front pivot mount rigidly secured to the bottom end of the vertical stand and the first opposing surface of the clamp comprises at least one front pivot secured beneath the front pivot mount positioned in contact with the top surface of the riser step. Preferably this at least one front pivot comprises a pair of front pivots secured at opposing ends of the front pivot mount. The securing member according to this first embodiment comprises a lock bar having a first end and a second end. The first end is hingedly attached to the arm member and the second end is attached to the arm offset member with a lock bar spring extending between the lock bar and the arm offset member. A lock bar hinge pin hingedly attaches the lock bar to the arm member. This lock bar hinge pin allows the lock bar to pivot and lock the standing aid in place about the back portion of the riser step by a force provided by said lock bar spring. An L-shaped lip portion is provided on a top surface of the lock bar which is capable of cooperating with a downwardly extending portion of the riser step to lock the standing aid in place.

According to a second embodiment, the mounting system and securing member of the invention comprises a clamp having a first and second opposing surface wherein the securing member comprises a vertically extending holding bar having a first end pivotally secured to the vertical stand and a second end holding a horizontally extending mounting bar. The first opposing surface of the clamp of the mounting system comprises at least one contact member extending from the horizontally extending mounting bar. Preferably, this at least one contact member comprises a pair of contact members positioned at opposing ends of the horizontally extending mounting bar. The pair of contact members is capable of being adjusted with respect to a particular height of the riser step. In order to secure the standing aid to the riser step, the holding bar is capable of being manually pivoted in a downward direction to bring the pair of contact members into contact with the riser step during attachment of the standing aid to the riser step. During removal of the standing aid, the holding bar is manually pivoted in an upward direction to disengage the pair of contact members with the riser step. The clamp of the mounting system comprises a C-shaped member having a first member, second member, and third member. The first member is secured to a bottom of the vertical stand extending above and parallel with respect to the riser step. The second member has a top portion secured to an end of the first member and extends perpendicularly with respect to the riser step. The third member is secured to an opposite end of the second member and extends below and parallel with respect to such riser step. The second opposing surface of the clamp comprises at least one spacer secured to a top surface of this third member.

These and other features and characteristics of the present invention, as well as the methods of operation and functions of the related elements of structures and the combination of parts and economies of manufacture, will become more apparent upon consideration of the following description with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification, the singular form of "a", "an", and "the" include plural reference unless the context clearly dictates otherwise.

DETAILED DESCRIPTION OF THE INVENTION

Figure 1:
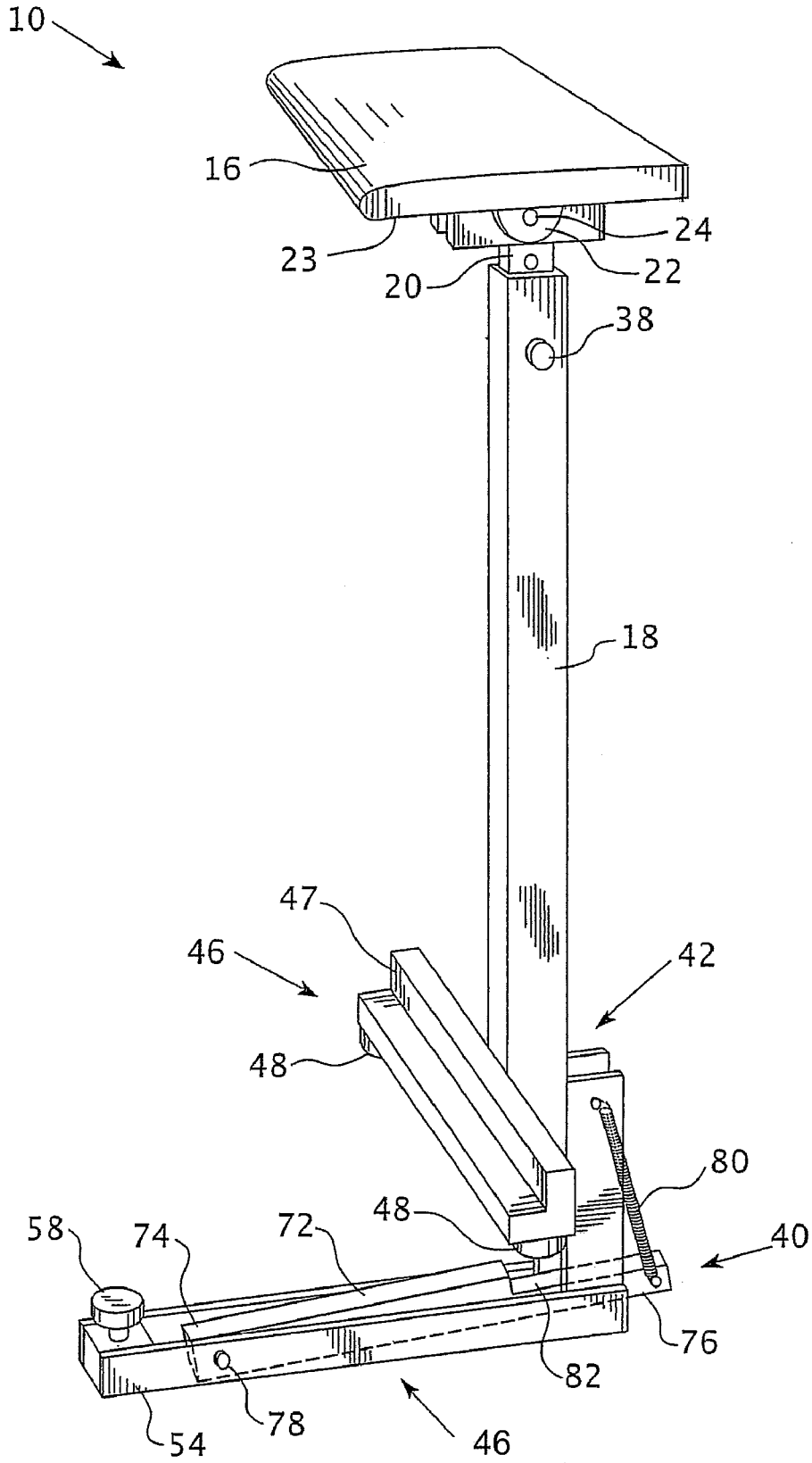
FIG. 1 shows a perspective view of the standing aid according to a first embodiment of the invention.

For purposes of the description hereinafter, spatial or directional terms shall relate to the invention as it is oriented in the drawing figures. However, it is to be understood that the invention may assume various alternative variations, except where expressly specified to the contrary. It is also to be understood that the specific components illustrated in the attached drawings, and described in the following specification, are simply exemplary embodiments of the invention. Hence, specific dimensions and other physical characteristics related to the embodiments disclosed herein are not to be considered as limiting.

As illustrated in the FIGS. 1-6, the present invention is directed to a standing aid, generally indicated as 10, 100, for supporting a person standing on a riser step 12. The riser step 12 has a first predetermined width 14. The standing aid 10 comprises a seat 16 which is capable of supporting a person standing on the riser step 12. A vertical stand, generally indicated as 18, has a top end 20 which is pivotally secured to the seat 16 through the use of a pivotal mounting member, such as a seat angle adjustment member 22 mounted to a bottom surface 23 of the seat 16 and pivotally attached to the vertical stand 18 through the use of a pin member 24 entering through an aperture in the seat angle adjustment member 22 and an aperture in the top end 20 of the vertical stand 18. The seat angle adjustment member 22 allows the seat to be angled as needed to comfortably support the user from a near standing position to a sitting position.

The vertical stand 18 comprises a pair of telescoping tube members 26, 28 wherein the inner tube 26 is movable with respect to the outer tube 28 for adjusting the height of the seat 16. The inner tube 26 includes a plurality of aperture pairs 30 extending through opposing sidewall portions 32 of the inner tube 26. The aperture pairs 30 can be provided, for example, at one inch increments along the inner tube 26, or any length increments, depending on the desired height adjustment choices. The outer tube 28 includes at least one aperture pair 34 extending through opposing sidewall portions 36 of the outer tube 28. The aperture pairs 30 of the inner tube 26 are capable of being aligned with the at least one aperture pair 34 of the outer tube 28. The aligned aperture pairs 30, 34 are capable of receiving an adjustment pin 38 therein to adjust the height of the seat 16 of the standing aid 10.

Figure 2:
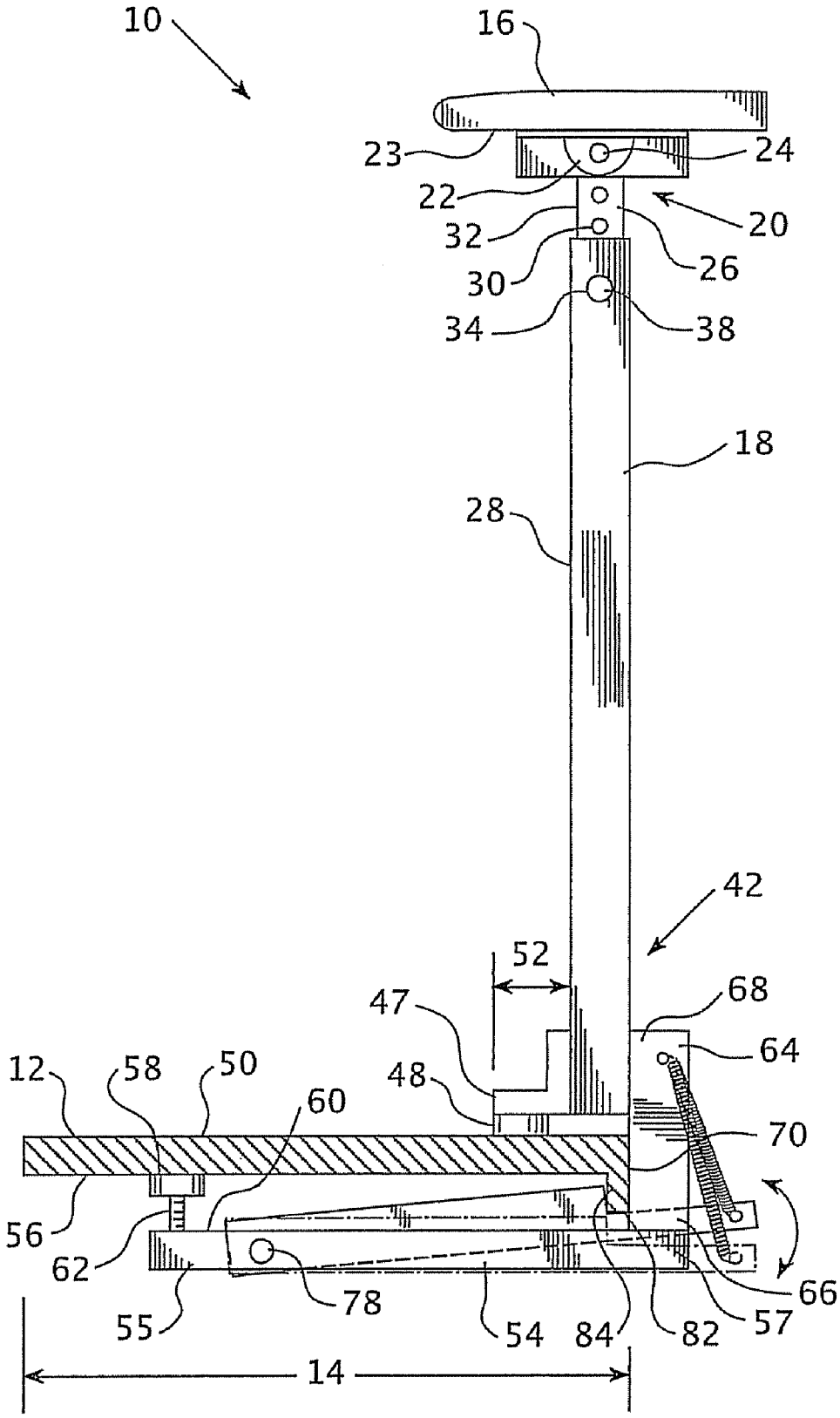
FIG. 2 shows a side elevational view of the standing aid of FIG. 1 mounted on a riser step.
Figure 3:
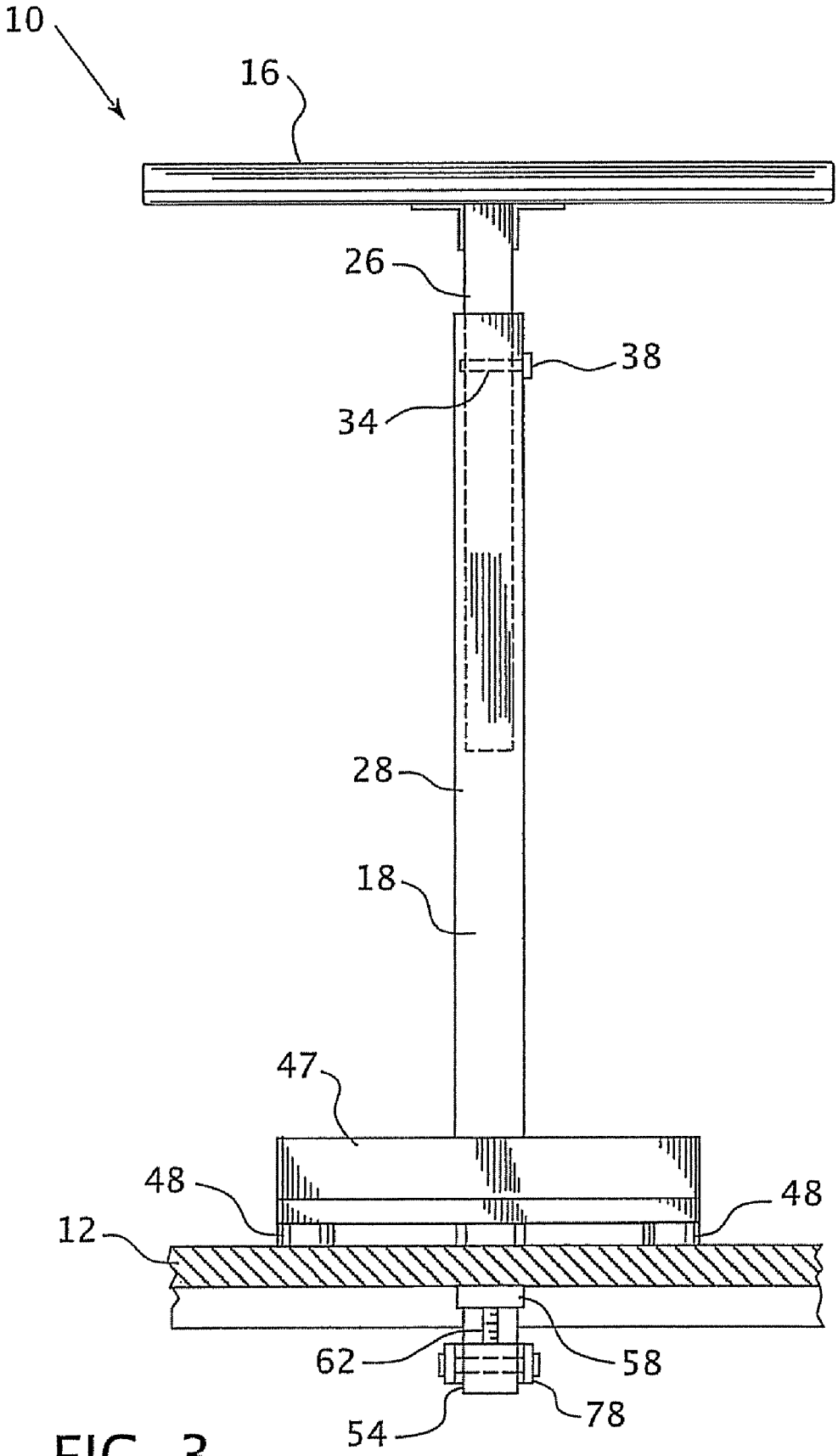
FIG. 3 shows a front elevational view of the standing aid of FIG. 1 mounted on a riser step.

According to a first embodiment, as illustrated in FIGS. 1-3, the standing aid 10 includes a mounting system, generally indicated as 40, secured to a bottom end 42 of the vertical stand 18. The mounting system comprises a clamp having a first opposing surface, generally indicated as 44, and a bottom opposing surface, generally indicated as 46. The first opposing surface 44 comprises a front pivot mount 47 in the form of a horizontally extending bar extending in a parallel direction with respect to the riser step 12. This front pivot mount 47 is rigidly secured to the bottom end 42 of the vertical stand 18. The first opposing surface of the clamp comprises at least one front pivot 48 secured to a bottom surface of the front pivot mount 47 and extending parallel to and in contact with a top surface 50 of the riser step 12. Preferably, a pair of front pivots 48 is provided in contact with top surface 50 of the riser step 12. The front pivots 48 have a second predetermined width 52 which is less than the first predetermined width 14 of the riser step 12. This second predetermined width 52 of the front pivots 48 is such that it produces a relatively small footprint with respect to the first predetermined width 14 of the riser step 12 enabling people to easily maneuver around the standing aid 10 as it is mounted on the riser step 12. The bottom portion 46 of the mounting system 40 comprises an arm member 54 extending below and parallel to a bottom surface 56 of the riser step 12. The particular mounting system design of the invention provides a secure clamping force on the riser steps 12 while minimizing the footprint of the standing aid 10.

A bottom contact bar 58 is adjustably secured at one end 55 of a top surface 60 of the bottom arm member 54. The bottom contact bar 58 is capable of being placed in abutment with the bottom surface 56 of the riser step 12 and adjusted according to a particular thickness of the riser step 12. Adjustment can be achieved through the use of a threaded connecting member 62.

An arm offset member 64 has a first end 66 which connects to a second end 57 of the bottom arm member 54 and a second end 68 which connects to the bottom end 42 of the vertical stand 18. This arm offset member 64 extends in a perpendicular direction with respect to the riser step 12. The lever arm offset 64 is mounted such that upon placement of the standing aid about the riser step 12, the arm offset member 64 extends in a perpendicular direction with respect to the back portion 70 of the riser step 12. The arm offset member 64 is, preferably, rigidly secured to the vertical stand 18 and the arm member 54 such as by welding or any other well known securing technique.

The securing member according to this first embodiment comprises a lock bar 72 having a first end 74 and a second end 76. The first end 74 is hingedly secured to the lever arm 54 with a lock bar hinge pin 78 and the second end 76 is attached to the arm offset member 64 with a lock bar spring 80 extending between the lock bar 72 and the arm offset member 64 for securing the mounting system 40 about the back portion 70 of the riser step 12. The lock bar hinge pin 78 allows the lock bar 72 to pivot thereabout and lock the standing aid 10 about the back edge portion 70 of the riser step 12 by force provided by the lock bar spring 80. The lock bar 72 can include an L-shaped lip portion 82 which locks in place against a back edge leg 84 extending downwardly from the back portion of the bottom surface 56 of the riser step 12. This particular lock bar design prevents accidental dislodging of the standing aid. In order to remove the standing aid 10 from the riser step 12, one need only to apply a forward force to the lock bar 72, the forward movement of which is facilitated by the lock bar spring 80, to disengage the L-shaped lip portion 82 from the back edge leg 84.

Figure 4:
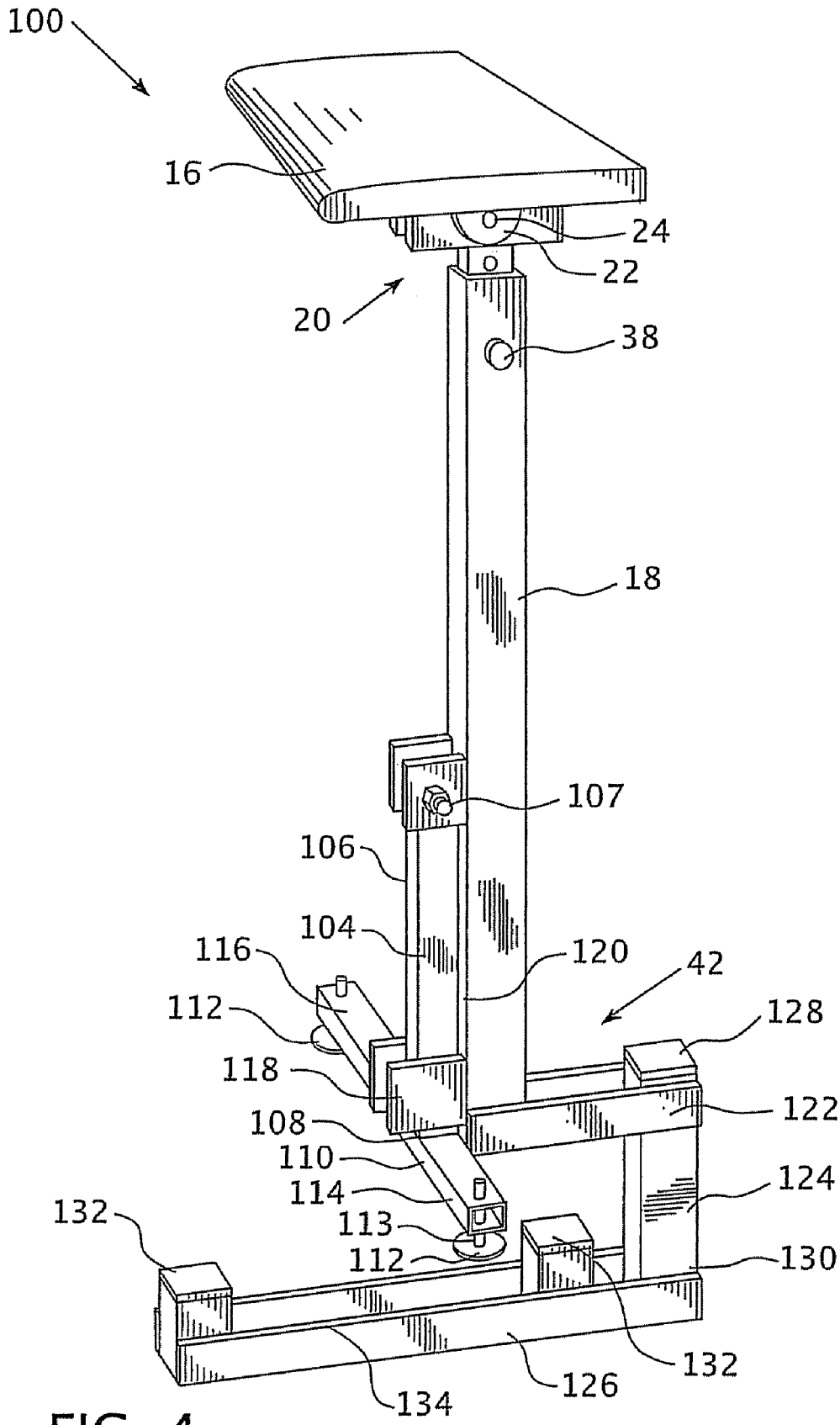
FIG. 4 shows a perspective view of the standing aid according to a second embodiment of the invention.
Figure 5:
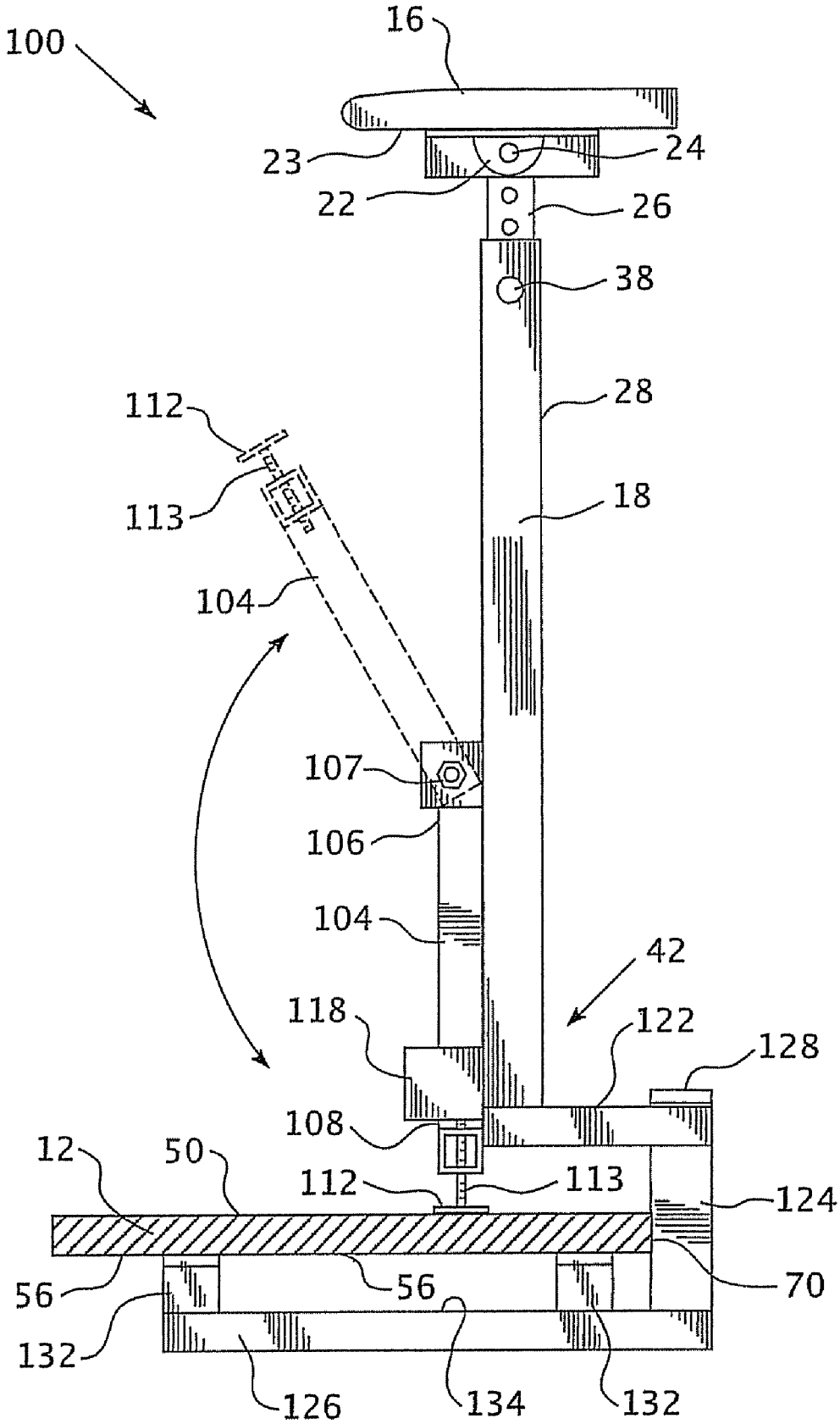
FIG. 5 shows a side elevational view of the standing aid of FIG. 4 mounted on a riser step.
Figure 6:
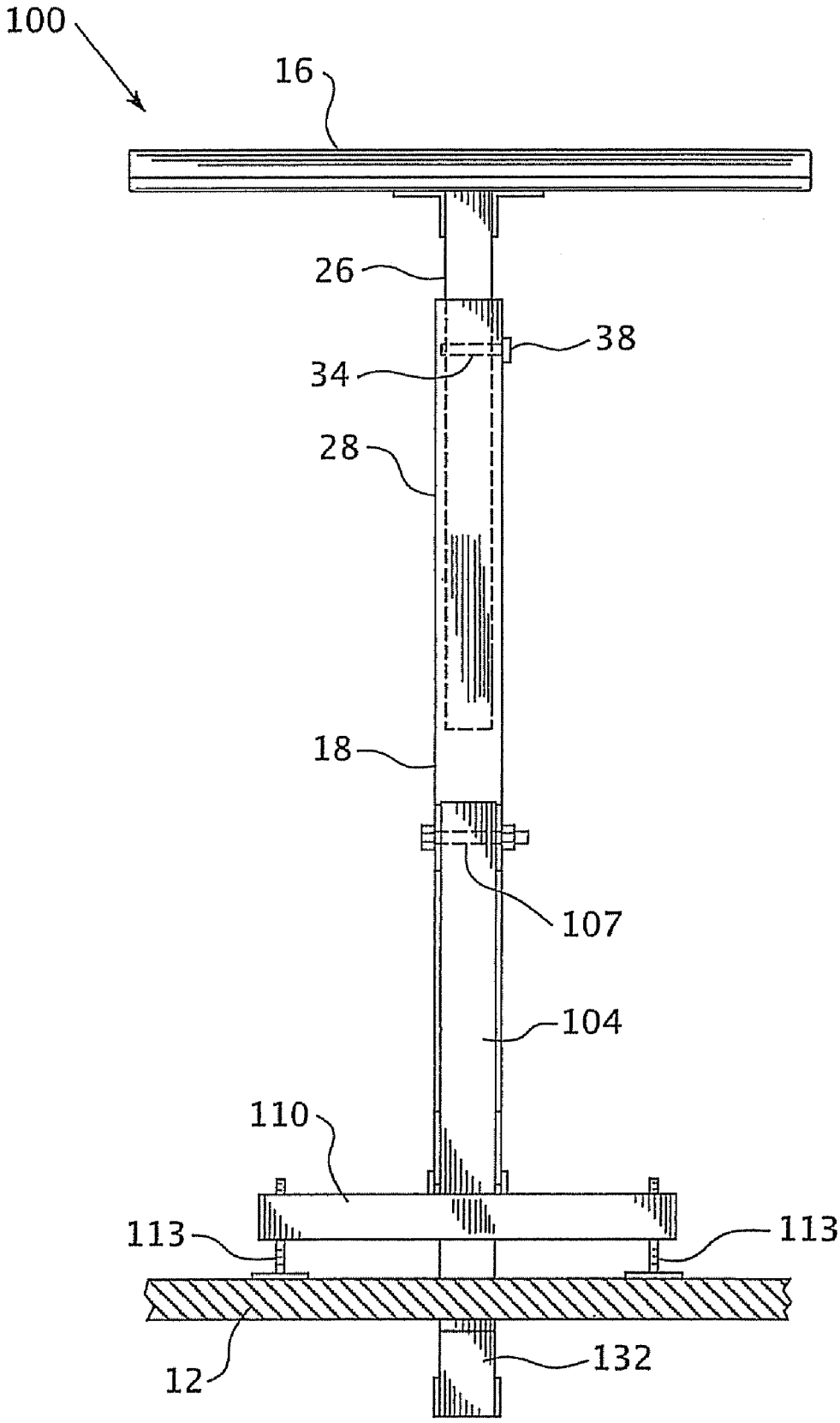
FIG. 6 shows a front elevational view of the standing aid of FIG. 4 mounted on a riser step.

FIGS. 4-6 illustrate the standing aid 100 including a mounting system and securing system according to a second embodiment of the invention. In this second embodiment, the securing member, generally indicated as 102, comprises a vertically extending holding bar 104 having a first end 106 pivotally secured to the vertical stand 18, such as with a screw/washer 107 or the like, and a second end 108 holding a horizontally extending mounting bar 110. In this second embodiment, the first opposing surface of the clamp comprises at least one contact member 112 extending from the horizontally extending mounting bar 110 which comes into contact with the top surface 50 of the riser step 12. Preferably, a pair of contact members 112 is provided wherein a contact member 112 is positioned at opposing ends 114, 116 of the horizontally extending mounting bar 110. This pair of contact members 112 is capable of being adjusted with respect to a particular height of the riser step 12. Adjusting screw members 113 or any other well known adjusting members may be provided for adjusting the height of the contact members 112.

In order to secure the standing aid 100 to the riser step, the holding bar 104 is capable of being manually pivoted in a downward direction to bring the pair of contact members 112 into contact with the riser step 12 during attachment of the standing aid 100 to the riser step 12. In order to remove the standing aid 100 from the riser step 12, the holding bar 104 is manually pivoted in an upward direction to disengage the pair of contact members 112 from the riser step 12.

A shielding member 118 extends a predetermined distance from a side portion 120 of the vertical stand 18 for shielding the holding bar 104 from accidental pivotal dislodgement of the contact members 112 from the riser step 12.

The mounting system 40 includes a clamp comprising a C-shaped member having a first member 122, second member 124, and third member 126. The first member 122 is secured to the bottom 42 of the vertical stand 18 and extends above and parallel with respect to the riser step 12. The second member 124 has a top end portion 128 secured to an end of said first member 122 and extending perpendicular with respect to the riser step 12. The second member 124 abuts the back surface 70 of the riser step 12 upon attachment of the standing aid 100 to the riser step 12. The third member 126 is secured to a bottom end portion 130 of the second member 124. This third member 126 extends below and parallel with respect to the riser step 12. The second opposing surface of the clamp comprises at least one spacer 132, preferably at least two spacers, extending above a top surface 134 of the third member 126. These spacers 132 abut the bottom surface 56 of the riser step 12.

The standing aid of the present invention allows people to participate in performances that were unable to participate in the past due to back or leg problems. The standing aid supports performers in a sitting or near standing position, via an adjustable height and seat angle, so that the use of the standing aid on the riser is undetectable by the audience. The standing aid is lightweight, sturdy, and compact which allows for easy transportation and storage, as well as easy installation and removal from the riser step. The footprint of the standing aid is very small on the riser step and, thus, provides little or no impedance to movement on the risers. Furthermore, the standing aid locates the center of gravity of the user behind the top of the step pivot point and provides a counteracting moment by use of the lever arm and bottom contact point thus creating a binding force on the step. The safety locking bar automatically snaps in to a secure locking position when the device is set in place and must be intentionally depressed in order to remove the device from the step, thus preventing accidental dislodging.

Although the invention has been described in detail for the purpose of illustration based on what is currently considered to be the most practical and preferred embodiments it is to be understood that such detail is solely for that purpose and that the invention is not limited to the disclosed embodiments, but, on the contrary, is intended to cover modifications and equivalent arrangements that are within the spirit and scope of this description. For example, it is to be understood that the present invention contemplates that, to the extent possible, one or more features of any embodiment can be combined with one or more features of any other embodiment.

The invention claimed is:

1. A standing aid for supporting a person standing on a riser step, such riser step having a first predetermined width, said standing aid comprising:

(a) a seat adapted to support a person standing on such riser step;

(b) a vertical stand having a top end secured to said seat;

(c) a mounting system secured to a bottom end of said vertical stand, said mounting system comprising a clamp having a first and second opposing surface, said first surface adapted to extend over and into contact with a top surface of such riser step toward a rear edge of said riser step, and said second surface adapted to extend below and into contact with a bottom surface of such riser step, said second surface adapted to be spaced in a transverse direction relative to the riser step from said first surface toward a front edge of said riser step, wherein said top portion has a second predetermined width which is less than such first predetermined width of such riser step; and (d) a securing member for securing said mounting system about such riser step.

2. The standing aid of claim 1 including a pivotal mounting member mounted to a bottom surface of said seat and pivotally attached to said vertical stand for adjusting the angle of said seat.

3. The standing aid of claim 1 wherein said vertical stand comprises a pair of telescoping tubular members having an inner and an outer tubular member and wherein said inner tubular member is movable with respect to said outer tubular member for adjusting the height of said seat with respect to such riser step.

4. The standing aid of claim 3 wherein said inner tubular member includes a plurality of aperture pairs extending through opposing sidewall portions of said inner tubular member and said outer tubular member includes at least one aperture pair extending through opposing sidewall portions of said outer tubular member and wherein said aperture pairs of said inner tubular member are adapted to be aligned with said at least one aperture pair of said outer tubular member and wherein said aligned aperture pairs are adapted to receive an adjustment pin therein to adjust the height of said standing aid.

5. The standing aid of claim 1 wherein said second opposing surface comprises a bottom contact bar adjustably mounted on a first end of a bottom arm member, said bottom arm member adapted to extend in a parallel direction with respect to such riser step.

6. The standing aid of claim 5 wherein said mounting system includes an arm offset member connecting a second end of said bottom arm member and said bottom end of said vertical stand wherein said arm offset member extends in a perpendicular direction with respect to such riser step.

7. The standing aid of claim 6 wherein said securing member comprises a lock bar having a first end and a second end and wherein said first end is hingedly attached to said arm member and said second end is attached to said arm offset member with a lock bar spring extending between said lock bar and said arm offset member.

8. The standing aid of claim 7 including a lock bar hinge pin for hingedly attaching said lock bar to said arm member and wherein said lock bar hinge pin allows said lock bar to pivot and lock said standing aid in place about such back portion of such riser step by a force provided by said lock bar spring.

9. The standing aid of claim 7 wherein said lock bar includes an L-shaped lip portion on a top surface thereof adapted to cooperate with a downwardly extending portion of such riser step for locking said standing aid in place.

10. The standing aid of claim 7 wherein said clamp comprises a C-shaped member having a first member, second member, and third member, wherein said first member is secured to a bottom of said vertical stand adapted to extend above and parallel with respect to such riser step, said second member having a top end portion secured to an end of said first member and adapted to extend perpendicular with respect to such riser step, and said third member secured to a bottom end portion of said second member and adapted to extend below and parallel with respect to such riser step.

11. The standing aid of claim 10 wherein at least a portion of said second member is adapted to abut a back surface of such riser step and said second opposing surface of said clamp comprises at least one spacer secured to a top surface of said third member which is adapted to contact said bottom surface of such riser step upon attachment of said standing aid to such riser step.

12. The standing aid of claim 1 wherein said mounting system includes a front pivot mount rigidly secured to said bottom end of said vertical stand and said first opposing surface of said clamp comprises at least one front pivot secured beneath said front pivot mount adapted to be positioned into contact with such top surface of such riser step.

13. The standing aid of claim 12 wherein said at least one front pivot comprises a pair of front pivots wherein the front pivots are secured at opposing ends of said front pivot mount.

14. The standing aid of claim 1 wherein said securing member comprises a vertically extending holding bar having a first end pivotally secured to said vertical stand and a second end holding a horizontally extending mounting bar.

15. The standing aid of claim 14 wherein said first opposing surface of said clamp comprises at least one contact member extending from said horizontally extending mounting bar.

16. The standing aid of claim 15 wherein said at least one contact member comprises a pair of contact members wherein the contact members are positioned at opposing ends of said horizontally extending mounting bar.

17. The standing aid of claim 16 wherein said pair of contact members are adapted to be adjusted with respect to a particular height of such riser step.

18. The standing aid of claim 17 wherein said holding bar is adapted to be manually pivoted in a downward direction to bring said pair of contact members into contact with such riser step during attachment of said standing aid to such riser step and manually pivoted in an upward direction to disengage said pair of contact members with such riser step during removal of said standing aid from such riser step.

19. The standing aid of claim 18 including a shielding member extending a predetermined distance from a side portion of said vertical stand for shielding said holding bar from accidental pivotal dislodgement of said contact members from such riser step.

20. A standing aid for supporting a person standing on a riser step, said standing aid comprising:

(a) a seat adapted to support a person standing on such riser step;

(b) a vertical stand having a top end secured to said seat;

(c) a mounting system secured to a bottom end of said vertical stand, said mounting system comprising a C-shaped member having a first member, second member, and third member, wherein said first member is secured to a bottom of said vertical stand and is adapted to extend above and parallel with respect to such riser step, said second member has a top end portion secured to an end of said first member and is adapted to extend perpendicular with respect to such riser step, and said third member is secured to a bottom end portion of said second member and is adapted to extend below and parallel with respect to such riser step, wherein upon application of said standing aid to such riser step, at least a portion of said second member is adapted to abut a back surface of such riser step and said third member includes at least one spacer secured to a top surface thereof which is adapted to contact said bottom surface of such riser step; and (d) a securing member comprising a vertically extending holding bar having a first end pivotally secured to said vertical stand and a second end holding a horizontally extending mounting bar, said horizontally extending mounting bar including at least one contact member wherein said holding bar is adapted to be manually pivoted in a downward direction to bring said at least one contact member into contact with such riser step during attachment of said standing aid to such riser step and manually pivoted in an upward direction to disengage said at least one contact member with such riser step during removal of said standing aid from such riser step.

* * * * *